235-411 SR
3/3/87 OR 4,647,759

United States Patent [19]
Worsham et al.

[11] Patent Number: 4,647,759
[45] Date of Patent: Mar. 3, 1987

[54] FIRE CONTROL APPARATUS FOR A LASER WEAPON

[75] Inventors: Richard H. Worsham, Baltimore; John R. Clark, Catonsville, both of Md.

[73] Assignee: The United States of America as represented by the Secretary of the Air Force, Washington, D.C.

[21] Appl. No.: 792,373

[22] Filed: Oct. 29, 1985

[63] Continuation-in-part of application Ser. No. 511,689, filed July 7, 1983, abandoned.

[51] Int. Cl.[4] ..... G06F 15/58; F41G 3/06
[52] U.S. Cl. ..... 235/411; 235/404; 364/423
[58] Field of Search ..... 364/423; 235/404, 409, 235/410, 411, 412

[56] References Cited

U.S. PATENT DOCUMENTS 3,845,276 10/1974 Kendy et al. ..... 235/404
3,946,233 3/1976 Erben et al. ..... 250/347
3,997,762 12/1976 Ritchie et al. ..... 235/404
4,011,789 3/1977 Bresee, Jr. et al. ..... 89/41 EA
4,124,849 11/1978 Zahornasky et al. ..... 235/411 X
4,128,837 12/1978 Page ..... 235/412 X
4,205,589 6/1980 Engler et al. ..... 89/41 SW

FOREIGN PATENT DOCUMENTS 2098705 11/1982 United Kingdom ..... 364/423

*Primary Examiner*—Felix D. Gruber
*Attorney, Agent, or Firm*—William Stepanishen; Donald J. Singer

[57] ABSTRACT

A laser weapon fire control computer apparatus for responding in real time to the escort/threat scenario that confronts the weapon. The first control computer apparatus compares the threat data with stored predicted scenarios to develop a firing strategy menu which takes into account the fact that the laser energy is instantaneously propagated to the target but requires a substantial amount of time to inflict damage. The fire control computer apparatus utilizes the weapon's status, dwell time, slew time and fuel limits to yield a weapon pointing sequence and weapon on-off times.

5 Claims, 6 Drawing Figures

FIG. 4
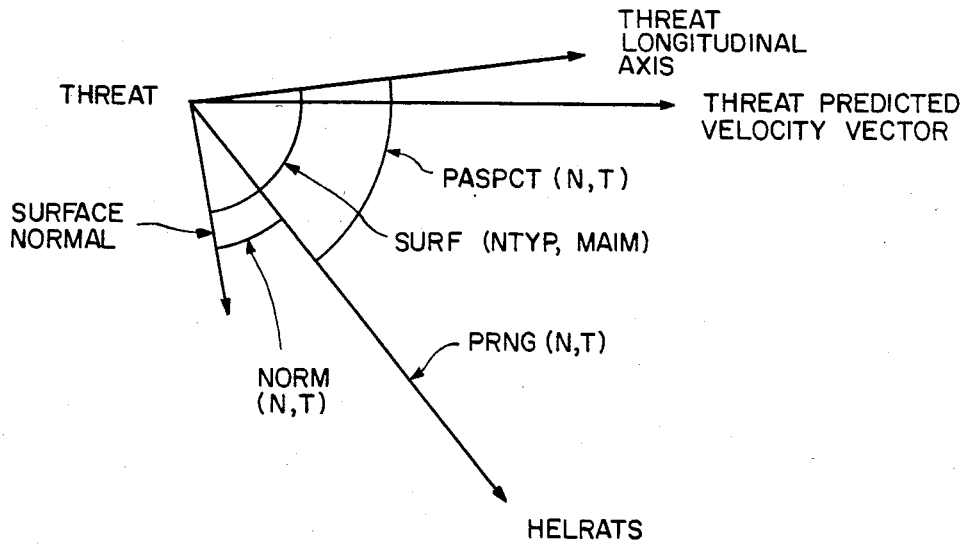
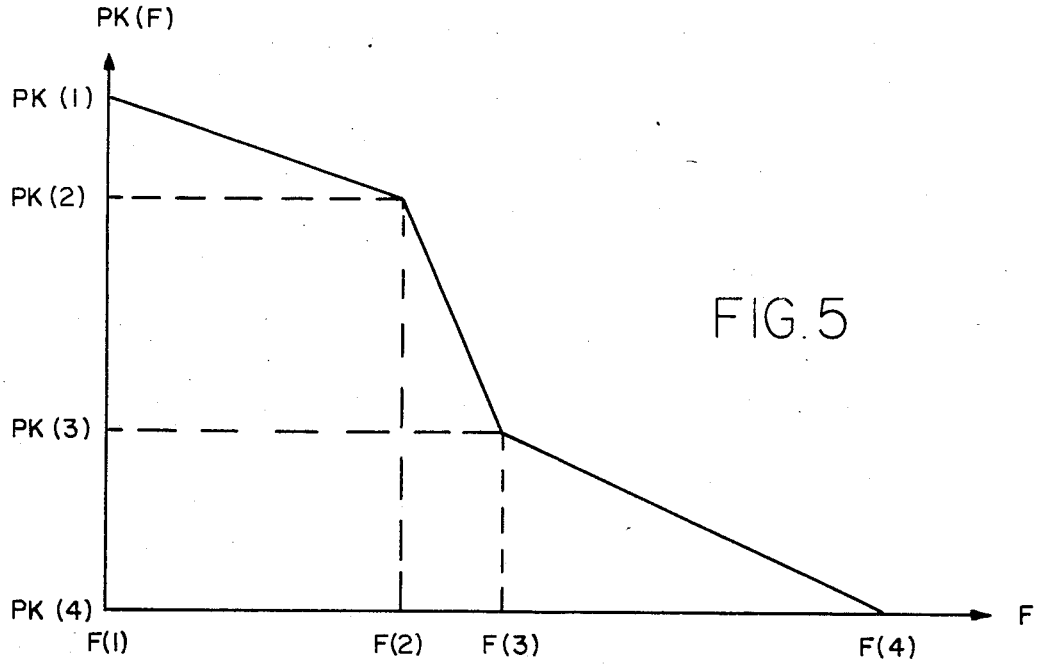
FIG. 5

FIRE CONTROL APPARATUS FOR A LASER WEAPON

STATEMENT OF GOVERNMENT INTEREST

The invention described herein may be manufactured and used by or for the Government for governmental purposes without the payment of any royalty thereon.

This is a continuation-in-part of application Ser. No. 511,689, filed July 7, 1983, abandoned.

BACKGROUND OF THE INVENTION

The present invention relates broadly to a laser weapon system, and in particular to a laser weapon fire control apparatus.

The damage mechanism of a laser weapon differs significantly from that of conventional guns and missiles. While bullets have finite flight times to their targets and cause damage instantaneously, laser energy propagates instantaneously to its target but requires a substantial amount of time to inflict damage. This operational difference requires that the fire control apparatus which controls a laser weapon utilize the distinctive characteristics of the laser weapon. The control apparatus must consider the weapon dwell time for each target, which is an aspect of laser fire control systems that has been previously ignored. In addition, the laser fire control system will have to consider the laser weapon slew times and fuel limits, and must be capable of adapting in real time to multiple missile threat scenarios which evolve rapidly in fractions of seconds. These constraints are considerably more stringent than those which may occur during a conventional fire control problem.

In the prior art, there have not been any systems for a laser weapon fire control apparatus or process which have been implemented in real time. Although various techniques and approaches have been utilized, they generally suffer from two or more of the following deficiencies:

(1) It has not been implemented and tested in a real time system.

(2) It does not find a firing strategy which maximizes survivability and is globally optimal with respect to a realistic model of the engagement scenario.

(3) It cannot output firing strategies which are always feasible, even if they are non-optimal.

(4) It cannot revise firing strategies at a frequency which is high enough to allow the weapon system to adequately respond to a rapidly evolving threat scenario.

(5) It does not present the operator of the weapon system with a firing strategy which estimates future weapon activity for a substantial portion of the (if not the entire) engagement.

(6) It does not adequately consider weapon fuel limits and slewing times.

The present invention which provides a solution to the problems that exist in the prior art is the first laser weapon fire control apparatus that enhances ownship/escort survivability and is implemented in real time. It successfully copes with all of the various constraints mentioned above, and maximizes the joint probability of survival for the system being defended. The maximization is with respect to a realistic and dynamic model of the engagement scenario.

SUMMARY OF THE INVENTION

The present invention utlizes a laser weapon fire control apparatus which controls a laser weapon to enhance the survivability of the systems which are being defended by the laser weapon. The fire control apparatus responds in real time to the escort/threat scenario which confronts the weapon. The laser weapon fire control apparatus yields a weapon pointing sequence and controls the laser weapon on-off times.

It is one object of the present invention, therefore, to provide an improved laser weapon fire control apparatus by shifting a large part of the computational burden to the early part of the engagement where real time constraints are not as stringent.

It is another object of the present invention, to provide an improved laser weapon fire control apparatus by utilizing a high speed computer, which reduces computation times.

It is a further object of the present invention, therefore, to provide an improved laser weapon fire control apparatus by formulating the problem so that the global optimum can be found quickly and accurately while considering a wide variety of constraints.

It is yet another object of the present invention, to provide an improved laser weapon fire control apparatus by utilizing input data which is readily available in a real time system and which enables the control process to realistically evaluate the current engagement and predict its future development.

It is still another object of the present invention, to provide an improved laser weapon fire control apparatus by characterizing the situation as a resource allocation problem, so that the absolute values of data inputs which are not available lose much of their importance, and relative values which are more easily obtained become the driving factors.

These and other advantages, objects and features of the invention will become more apparent after considering the following description taken in conjunction with the illustrative embodiment in the accompanying drawings.

BRIEF DESCRIPTION OF THE DRAWING

FIG. 4 is a graphical representation of the situation at time T for threat N of type NTYP;

FIG. 5 is a graphical representation of the $P_K$ versus fluence delivered.

DESCRIPTION OF THE PREFERRED EMBODIMENT

Figure 1:
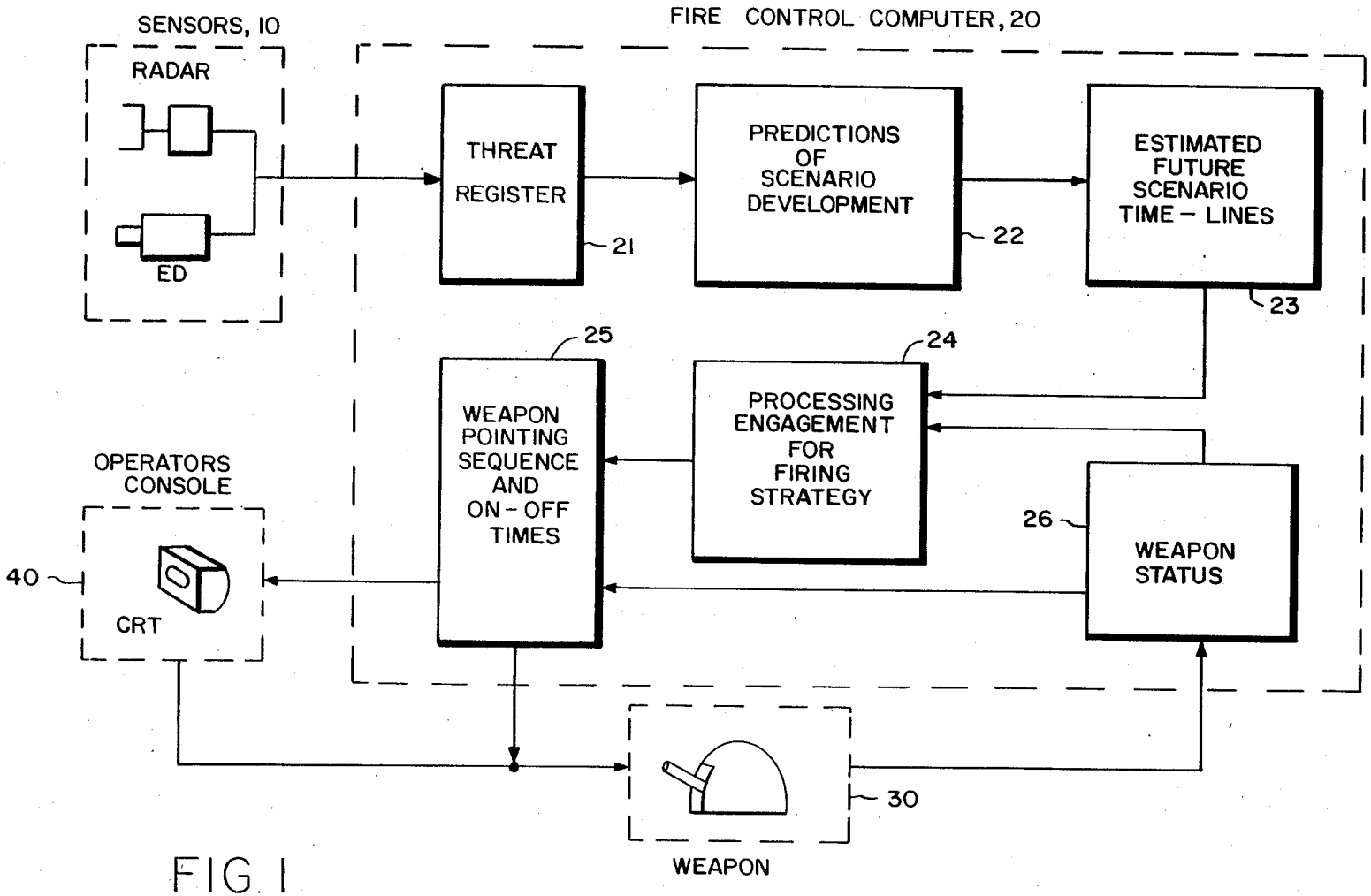
FIG. 1 is a block diagram of the laser weapon fire control apparatus according to the present invention.

Referring now to FIG. 1, there is shown a fire control apparatus for a laser weapon. The present apparatus utilizes conventional sensors 10 which may include a radar unit or other such type of electronic device to provide data concerning a hostile environment. An example of a hostile environment may include enemy aircraft activity in a given sector. The input data from the sensors 10 is applied to the fire control computer 20.

The fire control computer 20 may be implemented by any of the readily available general purpose computers of reasonable size and or capacity. An example of the type of general purpose computer that may be utilized, is the VAX model 11/780 or VAX model 11/750 which are both available from Digital Equipment Corporation of Maynard, Mass. The fire control computer 20 comprises a threat register unit 21 which receives the threat input data from sensors 10. The data from the threat register unit 21 is applied to the predictions of scenario development unit 22 which may comprise a memory unit with a plurality of pre-planned scenarios stored therein. The input data is compared to the stored scenarios. When a correlation occurs, a predicted scenario is sent to the estimated future scenario time-lines unit 23. A time-lines arrangement is established for the predicted scenario. The processing engagement for firing strategy unit 24 receives the estimated scenario time-lines and establishes a firing strategy for the various threat scenarios. The laser weapon 30 provides a weapon status signal to the weapon status unit 26 which in turn provides this signal to the firing strategy unit 24. The firing strategy unit 24 establishes a firing strategy for the various threat scenarios and applies it to the weapon pointing sequence and on-off times unit 25. The weapon pointing sequence, together with the firing burst of the laser weapon, are applied to the operator's console 40 for display and to the laser weapon 30. The operator's console 40 is connected to the laser weapon 30 for control of the laser weapon.

The fire control apparatus for the laser weapon operates in the following manner. The fire control apparatus transforms data inputs which are received from one or more of the sensors 10 into a weapon pointing sequence and weapon on-off time. This transformation is accomplished with the aid of the additional stored data delineating environmental, threat, and weapon characteristics, and with information regarding the current status of the weapon. The driving force behind the process is an attempt to characterize the survivability of those systems being defended by the weapon, and to develop a firing strategy which yields the greatest increase in the likelihood of that survival.

The threat register of the fire control apparatus utilizes the data which it gathers from on-board sensors 10 to characterize a threat/escort scenario in real time. This data resides in the threat/escort register unit 21, and is updated at frequencies which typically vary from five to twenty-five Hertz. It normally consists of the following items:

(1) threat/escort identification;
(2) threat/escort/ownship position vectors;
(3) threat/escort/ownship velocity vectors;
(4) ownship pressure altitude.

The above information is time-tagged and presented in a consistent coordinate system. While an automatic identification processor may be utilized to identify the various threat scenarios, the present example utilizes the threat identification which is provided a priority by the operator.

The predictions of scenario development unit 22 convolves the stored threat characteristics with information which is contained in the threat register unit 21. The scenario development unit 22 develops a set of time-lines which estimate the future positions, velocities, and attitudes of each threat. The scenario development unit 22 also uses environmental parameters and weapon characteristics to develop a set of flux (time rate of delivery of fluence) versus range curves, one such curve for each altitude of interest. Finally, the threat time-lines and the flux versus range curves are used to form a cumulative fluence versus time table for each threat. The tables give the amount of fluence which would be delivered to that threat if laser firing were to commence at the time corresponding to the beginning of the table and continue up to the particular time of interest.

All of the above tables are calculated early in the scenario, when real time constraints are not as stringent as they are late in the scenario. This is before actual weapon activity commences. They are updated only as necessary. It is necessary to update the tables when the actual real world scenario begins to significantly diverge from the estimated time-lines. This is checked by comparing the data in the threat register with the stored time-lines for equivalent times.

The estimated future scenario time-lines unit 23 is utilized to generate the tables created and stored by the fire control computer during the activity described above. These tables for each threat are:

1. Range from the weapon to that threat, versus time;
2. The aspect angle of that threat's longitudinal axis with respect to the line of sight (LOS) from that threat to the weapon, versus time;
3. The cumulative fluence versus time table for that threat.

In addition to the above tables, a set of tables which contain flux versus range curves, one table for each altitude of interest, is computed and stored. The altitudes of interest form an altitude grid which extends from the lowest average altitude between the weapon and any threat or escorted aircraft, to the highest average altitude. This set of tables is calculated once for a given engagement, and stored for the remainder of that engagement.

The weapon status unit is utilized to monitor the weapon status during the fire control process, and is used when processing the engagement to find the optimal firing strategy. The items monitored are:

1. Current weapon pointing angles;
2. Current weapon track mode (i.e., slewing, coarse track, precision track, spiral search, etc.);
3. Current beam status (on/off); and if on, the time at which firing commenced.

The processing engagement for firing strategy unit 24 utilizes the data gathered, generated, and stored by the above steps, and repeatedly generates firing strategies. The firing strategies are repeatedly generated so that they will quickly reflect new data, actively responding to the time-evolution of the engagement. The rate at which strategies are generated is typically five to ten Hertz.

The first step of this stage in the processing is to choose three times for each threat. These times are:

(1) The earliest time at which we can begin to deliver fluence to that threat, at or above a minimum rate.
(2) The latest time at which we can or at which we may wish to deliver fluence to that threat at or above a minimum rate.
(3) The time at which we estimate the rate of delivery of fluence will be at a maximum for that threat (lying between the earliest and latest times).

The second step orders threats into three sequences: one according to the earliest firing times, one according to the latest firing times, and one according to the maximum flux times.

The third step is repeated for each of the three sequences. It chooses that combination of open and cease fire times for all threats which maximizes an objective function that is stored in the computer. The key aspects of this process are:

(1) The fluence delivered by a specified shot time to a given threat is easily computed from the stored cumulative fluence versus time curve for that threat, by subtracting the fluence value at the open fire time from the fluence value at the cease fire time.

(2) The objective function being maximized is the sum of the logs of the probability of survival of each defended resource attacked by a threat. This is equivalent to maximizing the joint probability of survival. The log is taken so that the function is additive for the threats which are being lased. The additive property of the objective function is important, because it greatly simplifies the optimization process. The probability that the threat's target will survive is stored as a function of the amount of fluence which has been delivered to the threat. This function is converted to a log and tabularized, the table indices being related to the fluence delivered. The table is pre-calculated before the engagement begins. Thus, calculating the value of the objective function for a given amount of fluence is merely a table look-up, interpolated as necessary. This reduces the computational time required.

(3) The slewing constraints and fuel constraints are easily accounted for, because they merely restrict the set of firing windows which must be considered in the maximization effort. Additional constraints can be included as desired.

(4) The specific optimization technique for two threats, is the use a total search over a one-second grid, followed by a steepest gradient approach using a Fibonacci search to refine the solution to 0.1 sec.

The weapon pointing sequency and on-off times unit 25 utilizes the results of the fire control process which consists of a firing sequence and the begin and cease fire times for each threat. The operator by means of the operator's console 40 is presented with a time line display to inform him of scenario development. The weapon is controlled in real time by commanding pointing and tracking system mode, pointing direction, and turn-on/turn-off times in response to the real time inputs of firing strategy, threat/escort tracks, weapon status, and pointing and tracking system status. The weapon is slaved to the line of sight of the pointing and tracking system. The pointing and tracking system requests commands from the fire computer regularly (typically at 100 cycles) but asynchronously to the fire control computer process of firing strategy generation.

The pointing and tracking system is slewed to the highest priority threat by commanding weapon azimuth and elevation obtained through coordinate transformation. After weapon turn-on, fluence delivery is monitored until an amount of fluence sufficient to demand weapon shifting to succeeding threats is delivered. The weapon is commanded to succeeding threats until all fuel is exhausted.

1.0 Introduction

This section briefly outlines this overall structure of The Battle Plan Generator, used to compute the commands which control the laser weapon.

Figure 2:
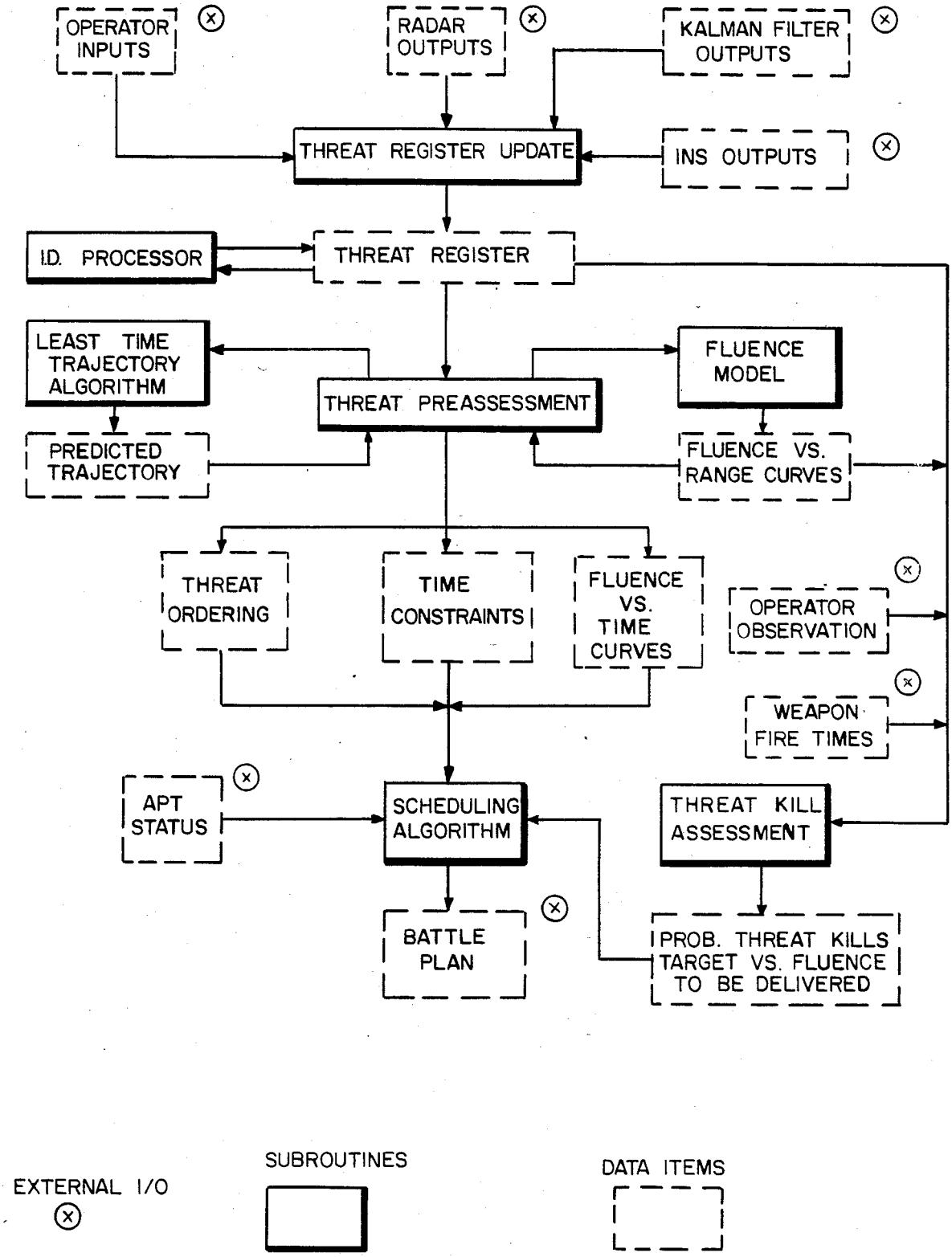
FIG. 2 is a detailed block diagram of the fire control computer apparatus.

Turning now to FIG. 2 there is shown the battle plan generator routines for the fire control computer. There are seven major subroutines in the battle plan generator. The data flow is shown in FIG. 2. The subroutines are:

(1) Threat Register Update Subroutine
(2) Threat Identification Processor
(3) Threat Preassessment Subroutine
(4) Least Time Trajectory Algorithm
(5) Fluence Model
(6) Scheduling Algorithm
(7) Threat Kill Assessment Subroutine The inputs, outputs, and basic functioning for each of the above are described in the following paragraph.

2.0 Threat Register Update Subroutine

As its title implies, this subroutine updates the threat register. The data inputs are from four sources, consisting of the following:

(1) Operator Inputs—The operator must provide threat identification data to the subroutine. Four categories of identification exist:

(a) Friendly or escorted aircraft,
(b) Enemy aircraft,
(c) Enemy ground threats,
(d) Enemy missiles.

The distinction between categories (a) and (b) is of prime importance, since the system has no other means of ascertaining whether a given target A/C is friend or foe.

The information provided must be tagged with an index which identifies that track in the threat register to which the given data applies.

(2) Radar Outputs—The RDP must provide the following information for each track in the threat register:

(a) Whether the track was established during a mini-search mode about an enemy A/C or ground threat.
(b) Whether the engine sideband processing indicates that the track is a missile or A/C.
(c) The signal amplitude of the returns associated with each track.

Information provided must be tagged so that it may be associated with the proper track. In addition, the radar parameters necessary to convert a signal amplitude into a target cross-section must be provided. Those values not provided will have assumed nominal values.

(3) Kalman Filter Outputs—The Kalman filter will supply position, velocity, and acceleration vectors for each threat in the register. The filter will also supply the time at which this given information was generated, and a flag indicating that threat in the register to which the given information applies.

(4) INS Outputs—The INS must provide the position and velocity vectors for the HELRATS platform, and its attitude.

The above four sources provide all of the threat register information needed to generate the battle plan and to perform threat identification. However, there are additional uses for the register, which will require additional data inputs. Their absence from this report is not meant to imply that they do not exist.

Those items required by the battle plan generator from the threat register are:

(1) Threat Number
(2) Threat Identity as determined from radar and operator inputs
(3) Threat Identity as determined by the I.D. processor
(4) Absence or presence of engine sidebands
(5) Whether or not threat was detected in mini-search or in queued search
(6) Signal amplitude
(7) Position vector (8) Velocity vector
(9) Acceleration vector
(10) Aspect angle
(11) Ownship parameters (position, velocity, attitude)

Other items which should probably be incorporated into the threat register (but are not needed to generate the battle plan) are:

(12) Priority flag, to indicate the necessity for mini-search or queued search, and the track data rate.
(13) Extrapolation parameters, supplied by the Kalman filter to enable extrapolation of threat state vectors from the time they were generated to time now.

3.0 Threat Identification Processor

The threat I.D. processor is identical to that described in the HELRATS final report. It will perform a threat identification based upon the information contained in the threat register.

Note that the threat identity established by the I.D. processor will not be used in the battle plan. The battle plan will regard all tracks established in mini-search or identified by the operator as missiles, and only those tracks will be considered.

4.0 Threat Preassessment Subroutine

This subroutine sets up all of the inputs required by the scheduling algorithm. To do so, it needs access to threat register items (1), (2), and (7)–(11).

The first step is the selection of those tracks identified as missiles in item (2) of the threat register. These are the only targets considered.

The second step is to call the least time trajectory algorithm. This establishes a predicted trajectory for the missile, and a time at which the missile reaches the keep out range.

The third step is to call the fluence model. This model computes a fluence versus range curve for that threat, i.e., the rate at which fluence would be delivered on a normal surface of that threat if fired on at that range.

The fourth step is to calculate the fluence vs. time curves for the threat, by combining the predicted trajectory with the fluence versus range curve. Those portions of the trajectory which are obscured by the ownship structure will have the rate of fluence delivery set to zero. (The rate will stay at zero for a period of time after the obscuration occurs, to allow reacquisition.)

The fifth step is to establish time constraints on the firing and cease-firing times for that threat. The earliest firing time is determined by the larger of two times: the first time that the fluence delivery rate versus time curve exceeds a threshold value, and the lowest time at which precision track could be established. The latest cease-firing time is established by the lesser of two times: the last time at which the fluence versus time curve yields a threshold fluence delivery rate, and the keep out time for that threat. The third time calculated is that time at which the fluence delivery rates reaches its maximum value. Finally, the time windows throughout which a conical scan acquisition mode will be required are specified. These windows are calculated from the predicted trajectory range and aspect angle.

Steps two through five are accomplished for each threat designated by step one.

The final step is specification of the order in which threats should be attacked. Three orderings are specified:

(1) Threats are ordered by the earliest fire times calculated in step five.
(2) Threats are ordered by the latest cease-firing times generated in step five.
(3) Threats are ordered by the times at which maximum fluence can be delivered to the threat.

The outputs of the threat preassessment routine are:

(1) The three threat orderings (Step 6)
(2) The time constraints (Step 5)
(3) The fluence versus time curves (Step 4)

5.0 Least Time Trajectory Algorithm

The inputs required by this algorithm are contained in items (1), (2), and (7)–(11). In addition, the time of launch for the missile is needed.

The least time trajectory algorithm computes a predicted trajectory for the missile. To compute this trajectory, the missile's target must be identified. Hence, this is the first step.

Identification of the missile's target is accomplished as follows. The missile's velocity vector is extended into space as a straight line. A cone is constructed about this straight line, with its apex at the missile. That friendly target which is inside the cone and closest to the missile is assumed to be the missile's target.

Once the target is established, the missile is assumed to fly a straight line collision course with the target. The thrust generated by the missile is varied according to his time of flight.

Given the predicted trajectory, the range from the HELRATS platform is computed as a function of time, along with the aspect of the missile and the HELRATS to missile line of sight. Finally, the time at which the missile reaches the keep out range with respect to its target is calculated. These data items are the output of the least trajectory algorithms.

6.0 Fluence Model

The fluence model is the simple propagation model developed by AFWL. The inputs required are:

(1) HELRATS altitute above sea level.
(2) Target altitude above sea level (average during the engagement).
(3) Power of HELRATS weapon.
(4) Ownship speed.*
(5) Wavelength of HELRATS weapon.
(6) Radius of output optics.
(7) Average angle between ownship velocity vector and ownship to missile line of sight during engagement.*
(8) Average angular slew velocity during engagement.*
(9) Minimum and maximum target ranges during engagement.
(10) Platform jitter due to ownship motion, and tracking and pointing.
(11) Relative humidity.
(12) Weather indicator—good or bad.

* Only needed if blooming is included.

Given the above inputs, the fluence model calculates a rate of fluence delivered versus range curve for each missile, extending from the minimum to the maximum ranges. If there is a significant variation in items (2), (7), and (8), then several such curves may be needed. However, it is currently anticipated that one curve will be sufficient for each threat.

The output of the fluence model is the set of calculated curves.

7.0 Threat Kill Assessment Subroutine

The threat kill assessment routine utilizes data from four sources.

These are:

(1) Operator Observation—If the operator decides that a given missile is not a threat any longer, he may tell the routine to regard that missile as having no capability.
(2) Threat Register items (1), (2), and (7)-(11).
(3) The fluence versus range curves for each threat.
(4) The HELRATS weapon fire and cease-fire times, and the threat fired upon. Note that if the weapon is firing, but there is no precision track (as in a conical scan acquisition mode), the relevant firing time for the kill assessment routine is the time that precision track is established.

Using items (2), (3), and (4), the routine calculates the amount of fluence delivered to the missile. An input from the operator signifying a threat kill would be transformed into the artificial deliverance of a large amount of energy.

The routine the modifies a curve which gives the probability that the missile will kill its target as a function of the amount of fluence delivered to the missile. The modification consists of shifting the origin of the curve forward to the amount of fluence delivered.

The modified curve for each threat is the output of the kill assessment subroutine, along with the time that the weapon actually opened fire (for fuel constraint purposes).

8.0 The Scheduling Algorithm

The scheduling algorithm is the heart of the battle plan generator. Its inputs are:
(1) The outputs of the threat preassessment subroutine (threat orderings, time constraints, fluence versus time curves, and the conical scan acquisition windows).
(2) The modified curves from the kill assessment subroutine, giving the probability that the missle will kill its target as a function of the fluence which may be delivered to that threat.
(3) The current status of the APT (current line of sight, and whether or not track is established on any given target, and if so, for how long).
(4) The time at which the weapon actually opened fire.

Using the above inputs, the scheduling algorithm calculates the optimal fire and cease-fire times for the threats, given the order in which the threats are attacked. These times are calculated for each of the three orderings, and the best of the three is output as the battle plan.

The criterion used maximization of the probability of survival of the missile's target.

The battle plan gives the firing and cease-firing times for each of the threats, and the sequence in which the threats are to be attacked.

As soon as the first battle plan is generated, the APT should be slewed to the first threat in the sequence. When the firing time for the threat is reached, the weapon fires. As soon as it ceases firing on that threat, it should slew to the next threat in the sequence.

Note that the battle plan is being updated while the system is executing the plan. Thus, the kill assessment will affect the weapon activity.

DETAILED DESCRIPTIONS OF THE THREAT PREASSESSMENT

Kill Assessment, and Fluence Models 1.0 Threat Preassessment Routine

The Threat Preassessment Routine is largely explained in the previous section, The Battle Plan Generator, paragraph 4.0. The following information clarifies some fine points.

1.1 Calculation of TMIN(N)

TMIN is the earliest time in the future at which HELRATS can begin to deliver fluence to the missile. If the acquisition mode for the tracker involves a spiral search preceeding a conical scan, TMIN is the time at which the conical scan begins. (This of course, assumes that F, the rate of fluence deliver, is large enough to be useful).

The acquisition mode must be specified. Let this be MACQ, with

MACQ=1: Spiral search acquistion
MACQ=2: Linear search acquistion
MACQ=3: Normal acquistion (no search).

Figure 3:
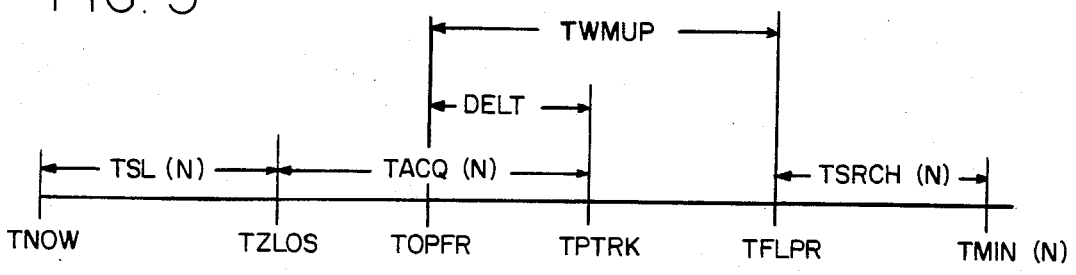
FIG. 3 is a graphical representation of the time sequence of events at acquisition with an immediate open-fire desired.

The situation is shown (for a typical set of inputs) in FIG. 3. The variables therein are defined as:

TNOW=Time now
TSL(N)=time required to slew from the current APT line of sight to the line of sight for threat N
TZLOS=time at which the difference between the threat and the APT LOS is less than some small $\epsilon$.
TACQ(N)=time required to achieve precision track after the LOS differential is zeroed at TZLOS
TOPFR=time the weapon is turned on
TPTRK=time at which the APT achieves precision track
DELT(MACQ)=waiting time or anticipatory time between TOPFR and TPTRK for acquisition mode MACQ. (The value shown in FIG. 3 is <0.)
TWMUP=time required for warm up, to achieve full power
TFLPR=time at which the weapon achieves full power
TSRCH(MACQ)=time spent in spiral (MACQ=1) or linear (MACQ=2) search to refine the aim point. For MACQ=3, TSRCH is the settling time after the establishment of precision track before the delivery of fluence can begin.
TMIN(N)=earliest time at which we can begin to deliver fluence to threat N.

From FIG. 3, the following relationships are clear:

$$TPTRK = TNOW + TSL(N) + TACQ(N)$$
$$TOPFR = TPTRK + DELT(MACQ)$$
$$TFLPR = TOPFR + TWMUP$$

We define the following additional variables:

FDMIN=threshold fluence delivery rate
TI(N)=first time at which F>FDMIN for the current predicted least time trajectory of threat N
NTRK=threat currently acquired (i.e., LOS differential has been zeroed) by the APT (coarse or precision track; spiral or linear search; conical scan). Set NTRK=0 if no threat is currently acquired Depending upon the variables involved, we may have TFLPR<TPTRK or TFLPR>TPTRK. The spiral or linear search begins at the larger of these times, given that sufficient fluence can be delivered to the target.

We thus define the beginning of search, for N≠NTRK and MACQ=1 or 2, as $$TBSRCH = MAX\,(TI(N),\ TFLPR,\ TPTRK).$$

Then, we have $$TMIN(N) = TBSRCH + TSRCH\,(MACQ)$$

for N≠NTRK; MACQ=1 or 2.

For MACQ=3, we must allow a settling time and the laser must be at full power delivering sufficient fluence. Hence, $$TMIN(N)=MAX(T1(N), TFLPR, TPTRK+TSRCH(MACQ))$$

for N≠NTRK; MACQ=3.

The situation N=NTRK is slightly more complicated. Since N=NTRK, we known that the LOS differential has been zeroed. Define the following times, which correspond to real world inputs (unlike the previously defined times which are estimates of future events, excepting TNOW):

TZLOSD=time at which a discrete signal, denoting that the APT and threat LOS differential is less than some $\epsilon$, is received (corresponds to TZLOS).

TPTD=time at which the discrete signal denoting beginning of precision track is received (corresponds to TPTRK).

TWPFR=time at which the command to open fire was sent to the weapon (corresponds to TOPFR)

TCONSD=time at which the discrete signal indicating that spiral search ends and conical scan begins, or that linear search ends, is received.

Then, in the same manner as before, we have

| | | |
|---|---|---|
| TPTRK | = | MAX(TNOW, TZLOSD + TACQ(NTRK)) if TPTD not received<br>TPTD if received |
| TOPFR | = | MAX(TNOW, TPTRK + DELT(MACQ)) if TWPFR not commanded<br>TWPFR is already commanded |
| TFLPR | = | TOPFR + TWMUP |

In defining TMIN(NTRK), we wish to insure that TMIN≧TNOW, and that T1(NTRK) has no influence if TWPFR has already has been commanded. For notational ease, we define the following variables:

$TT(1)=T1(NTRK)+TSRCH(MACQ)$ $TT(2)=TFLPR+TSRCH(MACQ)$ $TT(3)=TPTRK+TSRCH(MACQ)$

Then we have:

For MACQ=1 or 2,

| | |
|---|---|
| TMIN(NTRK) = | MAX[TNOW, TT(1), TT(2), TT(3)] if TCONSD has not been received and TWPRF has not been commanded<br>MAX[TNOW, TT(2), TT(3)] if TCONSD has not been received and TWPFR has been commanded<br>TNOW if TCONSD has been received |

For MACQ = 3,

| | |
|---|---|
| TMIN(NTRK) = | MAX[TNOW, T1(NTRK), TFLPR, TT(3)] if TWPFR has not been commanded<br>MAX[TNOW, TFLPR, TT(3)] if TWPFR has already been commanded |

Note that when TMIN(N) depends upon T1(N), which in turn depends upon the rate of fluence delivery, a two step calculation will be required. First we set T1(N)=TNOW−TSRCH(MACQ), calculating TMIN(N) for this value of T1(N). Then, starting with this value of TMIN(N), the rate of fluence delivery for threat N is calculated for times TMIN(N)+KΔT (ΔT=0.1 sec), K=0, 1, 2 . . . . The first time at which the rate of fluence delivery exceeds FDMIN is the correct value for TMIN(N). This two step calculation step calculation will be required unless we are calculating TMIN(NTRK) and we have already opened fire (TWPRF≦TNOW), in which case T1(NTRK) has no impact on TMIN(NTRK).

1.2 Calculation of TMAX(N)

TMAX is the latest time at which HELRATS is interested in firing upon a missile threat. For a system intended to operate in a "real world" environment, TMAX(N) would be the minimum of two times:

TI=latest time at which F>FDMIN for threat N

TKO=time at which threat N reaches the keep-out range with respect to its intended target.

In the test situation for which the current algorithm must be designed, there is further constaint on TMAX. This reflects the fact that the system must fire on threat N even if it does not reach its intended target. We express this constraint as a restriction that firing must cease within a specified time of the launch time for threat N. Defining the elapsed time after launch by which countering must have occurred as TCFTST (TCF test) we have (TL=time of launch).

$$TMAX(N)=MIN\ (T1, TK0, TL+TCFTST)$$

1.3 Calculation of Fluence vs. Time curves

Calculation of the cumulative versus time curve is done for each threat, each time its predicted trajectory changes.

The curve is calculated for T in the interval (TMIN(N), TMAX(N)).

From the least time trajectory calculation, we have the functions:

PRNG(N,T)=predicted range to threat N at time T

PASPCT(N,T)=predicted aspect angle of threat N with respect to the HELRATS to threat LOS at time T PA(N,T)=predicted average pressure altitude between threat N and HELRATS at time T.

On an apriori basis, the operator must type in a value of NTYP which denotes the threat type and remains constant for the day. The values are:

NTYP=1: Sidewinder air-to-air missile

NTYP=2: Falcon air-to-air missile

NTYP=3: Hawk ground-to-air missile

We assume that a forward aspect angle with a spiral search acquistion mode connotes, a nose acquistion, while a linear search connotes a side aspect body acquistion.

To specify the type of surface we are aiming at, we calculate an aim point index MAIM. The values of this index are:

MAIM=1: Nose shot with an ogive nose

MAIM=2: Body shot

MAIM=3: Nose shot with a hemispherical nose which is significantly larger than the weapon spot size.

For a sidewinder of Falcon, we have MAIM=3 for a nose shot. For a Hawk, MAIM=1 for a nose shot. The proper values of MAIM are shown in Table 1-1. The aspect angles at which a spiral search acquisition is regarded as a body shot are those exceeding 90°. Those aspect angles at which a linear search acquistion is regarded as a nose shot are those less than $\theta$, where

TABLE 1-1

Determination of the aim point MAIM.

$$\theta = \tan^{-1}\left(\frac{\text{missile diameter}}{\text{missile length}}\right)$$

| NTYP | MACQ | PASPCT(N,T) | MAIM |
|---|---|---|---|
| 3 | 1 | <90° | 1 |
| 3 | 2,3 | <4.1° | |
| 1,2,3 | 1 | ≧90° | 2 |
| 1 | 2,3 | ≧2.3° | |
| 2 | 2,3 | ≧4.4° | |
| 3 | 2,3 | ≧4.1° | |
| 1,2 | 1 | <90° | 3 |
| 1 | 2,3 | <2.3° | |
| 2 | 2,3 | <4.4° | |

As a fixed set of data inputs, we have (MAIM≦2)

SURF(NTYP,MAIM)=angle between the longitudinal axis of the missile and the normal of the surface being fired upon, for threat type NTYP and aim point MAIM. Thus, MAIM=1 implies the normal for the nose, while MAIM=2 implies the normal for the body.

For MAIM=3, we set

*SURF(NYTP,3)=PASPCT (N,T)*

The threat is assumed to be symmetric about its longitudinal axis.

FIG. 4 shows the assumed situation at time T. The angle between the surface normal and the HELRATS to threat LOS is NORM (N,T) for threat N at time T. This angle is a function of the threat type, the aim point, and the aspect angle. Using Table 1-1 to calculate MAIM, we have

*NORM(N,T)=ABS(PASPCT(N,T)−SURF(NTYP,-MAIM))*

From the fluence model, we have

FDOT(A,R)=rate of fluence delivery on a normal surface at a range R and an altitude A, where A is the average altitude between the weapon and its target.

We now have the means to compute the desired curve. Define

FLNCE(N,T)=the cumulative fluence which could be delivered on threat N in the interval (TMIN(N),T).

We initialize:

*FLNCE(N,TMIN)N))=0* and sequentially calculate

*FLNCE(N,T+ΔT)=FLNCE(N,T)+FDOT (PA(N,T) PRNG(N,T))*ΔT* COS (NORM (N,T)).*

In the above equation, if the cosine is less than zero, it should be set to zero. It is suggested that ΔT=0.1 sec. When T exceeds TMAX, we terminate the calculation. When FLNCE(N,T) is accessed with a value T>TMAX(N), set FLNCE(N,T)=FLNCE(N,T-MAX(N)).

Note that as the above table is being constructed, the incremental increase in FLNCE(N,T) should be compared against the largest increase which has occurred prior to time T. If it is greater than the largest increase, set TMXFL(N)=T. This is the time at which the rate of influence delivery is the greatest. (TMXFL(N) is initialized as TMIN(N).)

1.4 Data Inputs

The data inputs which are required as external inputs to the Battle Plan Generator in order to accomplish the above calculations are:

(1) TNOW
(2) APT inputs are necessary to calculate TSL(N)
(3) TACQ(N)
(4) DELT (MACQ)
(5) TWMUP
(6) TSRCH(MACQ)
(7) FDMIN
(8) NTRK
(9) TZLOSD
(10) TPTD
(11) TCONSD
(12) TL
(13) TCFTST
(14) NTYP
(15) MACQ
(16) SURF(NTYP, MAIM) for MAIM≦2

2. Threat Kill Assessment Routine

The threat kill assessment routine has two functions. Before the engagement begins, it initializes a table which gives the return for firing on a given threat and delivering a specified amount of fluence.

During the engagement, this routine calculates the fluence actually delivered to a given threat up to time now.

2.1 Initialization of the Function R(N,F)

As a data input, the following pair of values will be supplied for NTYP=1,2 and MAIM=1,2,3:

(PKD (NTYP, MAIM, I), FD (NTYP, MAIM, I)
I=1,4)

PKD represents the data input for the probability that a threat of type NTYP will kill its target given that a fluence FD has been delivered to aim point MAIM.

Given NTYP and MAIM, the kill assessment routine sets.

| | | | |
|---|---|---|---|
| PK(I) | = | PKD(NTYP, MAIM, I | I = 1,4 |
| F(I) | = | FD (NTYP, MAIM, I | |

This function is represented in FIG. 5. These four pairs completely specify the form of a piecewise linear function of the probability that the missile will kill its target (PK) versus the amount of fluence delivered on the missile (F). (Clearly, PK (4)=F(1)=0).

This curve must be transformed into a table from which the return R (N,FL) obtained by delivering a fluence FL on threat N is ascertained. This return is repeatedly calculated for use in the scheduling algorithm. The values N and FL are supplied by the scheduling algorithm. FL as supplied already includes the fluence delivered prior to time now, so that no adjustment is required. The value of N is not required in the current version of the battle plan because all threats are assumed to be of the same type, NTYP.

The table contains the values

*TR(J)*=ln [1−*PK*1(*F*1(*J*))], J=1, JMAX where

*F*1(*J*)=(*J*+0.5)**F*(4)/*JMAX*=(*J*+0.5)/*CONST* and PK1(F) is a linear interpolation on the four data points (PK(I), F(I)), as shown in FIG. 5.

Thus, to evaluate the function R(N, FL), we calculate (truncate the RHS)

$$J=FL*CONST.$$

If J≧JMAX, R(N, FL)=0. If J=0, set J=1. Then, $$R(N,FL)=TR(J).$$

Note that the calculation of J involves a multiplication. Since this is done a large number of times, any alternative method of obtaining J from FL which would be quicker should be utilized. (e.g., a bit shift). The test for J=0 may be avoided by incorporating a dummy location in front of the table TR(J), with the value of TR(1).

2.2 Calculation of Fluence Delivered

During the engagement, the scheduling algorithm uses the variable FLDL(N), which is the fluence delivered prior to time now on threat N. This variable must be computed by the kill assessment routine.

Define the following variables:

TNOW=time now

TLST=time that this routine was last called

TSTART(N)=time at which HELRATS began to deliver fluence on threat N. For a normal acquisition, this is TPTD+TSRCH(N). For a spiral or linear search, this is TCONSD (see Section 1.1)

TSTOP(N)=time at which HELRATS ceased firing on threat N

NTRK=threat currently being tracked by APT

AVALT(N)=average of current pressure altitudes of threat N and HELRATS

RNG(N)=current range to threat N

FDOT(A,R)=rate of delivery of fluence on a normal surface at range R and average altitude A ASPCT(N)=aspect angle of longitudinal axis of threat N with respect to the line of sight from HELRATS to threat N MAIM=aim point index The values of TLST and NTRK are initialized to zero at the beginning of the flight. The values TSTART(N), TSTOP(N), and FLDL(N) are set to zero when a track on threat N is first established by the APT. The values TNOW, NTRK, AVALT(N), RNG(N), and ASPCT(N) are provided by HELRATS. FDOT(A,R) is provided by the fluence model. The value of MAIM is calculated from Table 1-1 as before, but using ASPCT(N) in place of PASPCT(N,T). We set $$SURF(NTYP,3)=ASPCT(N)$$

as before.

Figure 6:
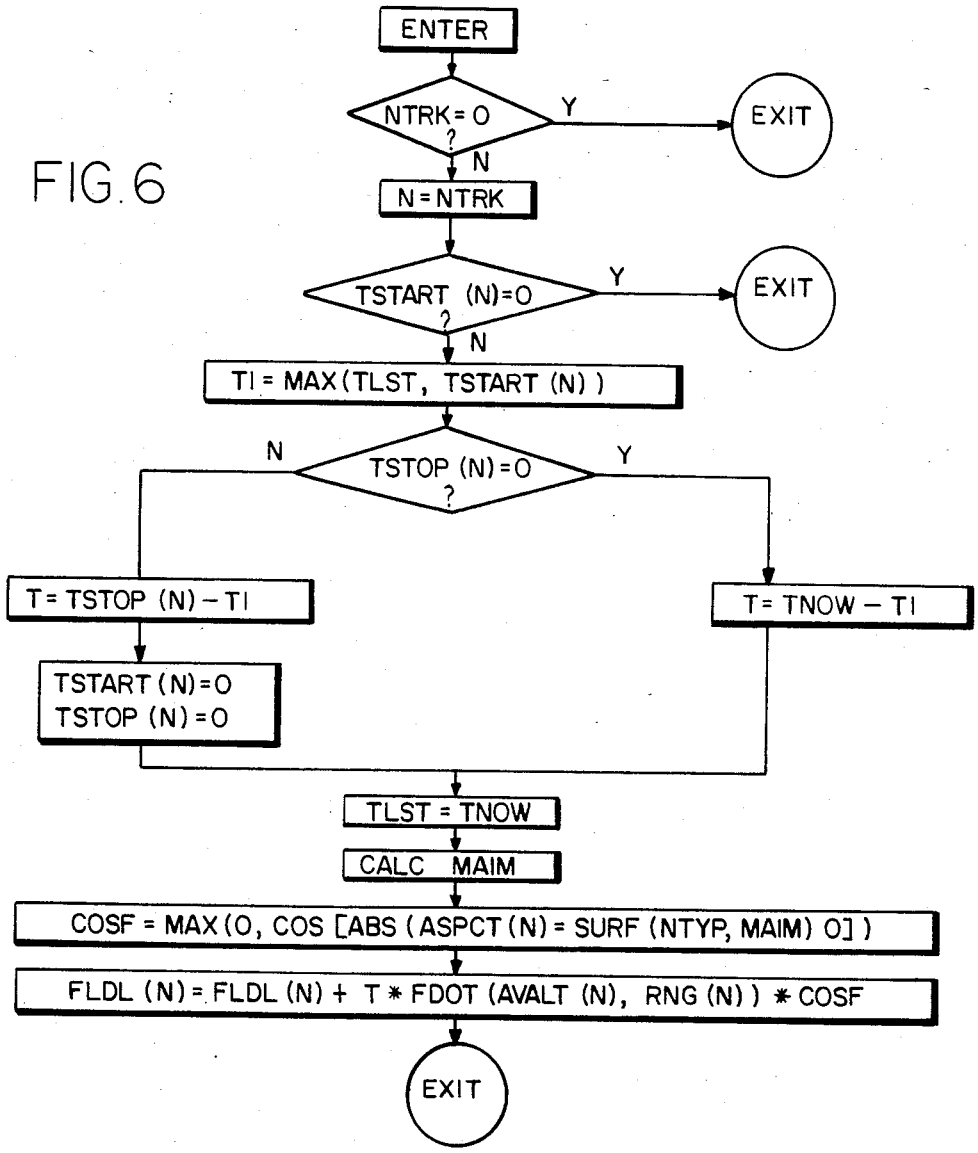
FIG. 6 is a flow diagram of the kill assessment routine for the calculation of FLDL(N).

When called, the routine calculates the amount of fluence delivered since the last time the routine was called. The flow chart in FIG. 6 illustrates this calculation. During firing, the calculation should be performed every 0.1 sec, at least.

2.3 Data Inputs

The data inputs required as external inputs to the Battle Plan Generator, in order to accomplish the above calculations, are:

(1) NTYP
(2) PKD(NTYP, MAIM I)
(3) FD(NTYP, MAIM, I)
(4) TNOW
(5) TSTART(N)
(6) TSTOP(N)
(7) NTRK
(8) AVALT(N)
(9) RNG(N)
(10) ASPCT(N)
(11) MACQ
(12) SURF(NTYP, MAIM), MAIM≦2

3. The fluence Model

The fluence model is used to provide a value for FDOT(A,R) when requested. It should be tabularized in altitude and range. In range, the table should extend from 0 to the maximum range of interest, in increments of 150 meters.

To establish the altitudes of interest, we calculate the following pressure altitudes:

$HT_i$=average altitude between HELRATS and the $i^{th}$ escorted friendly A/C $HM_n$=average altiltude between HELRATS and the $n^{th}$ missile threat H=current HELRATS altitude Then, the minimum altitude of interest is $$MINALT = \min[H, \min_i HT_i, \min_n HM_n]$$

The maximum altitude of interest is $$MAXALT = \max[H, \max_i HT_i, \max_n HM_n]$$

Therefore, we define $$KMIN = \frac{-H + MINALT}{AGRID} - 1$$

$$KMAX = \frac{MAXALT - H}{AGRID} + 1$$

where AGRID is the grid size for altitude. If the altitudes are in meters, AGRID=1500 meters.

The altitudes for which FDOT(A,R) is calculated are $$A=H+K*AGRID,\ KMIN\leqq K\leqq KMAX.$$

If the above yields A 0, use A=0.

The model used is identical to that described in the Laser System Effectiveness Model, Vol. I, Pg. 109–110. (AFWL-TR-74-17, Vol. I).

We define the following constants, which are supplied as inputs to the model. (All units are in joules, meters, and seconds)

$P_o$=nominal laser power

K=ratio of nominal to useful power exiting the aperture $K_{BS}$=beam shape factor which describes the angle to the first dark ring of the diffraction pattern $K_{BQ}$=beam quality factor or ratio of actual operating angle to ideal spreading angle λ=laser wavelength D=aperture diameter $R_{min}$=minimum focal range of the system $\theta_J$=spreading half-angle due to mechanical jitter Given the above constants, we can calculate the following beam spreading half-angles $\theta_D$=spreading half-angle due to diffraction $$\theta_D = \frac{K_{BS}K_{BQ}\lambda}{D}$$

$\theta_T$=spreading half-angle due to atmospheric turbulence $$\theta_T = 1.7[(C_n^2R)^3/\lambda]^{1/5}$$

where $C_n^2 = A^{-1.075} \times 10^{-13}$ $\theta_{MF}$=spreading half-angle due to out of focus condition $$\theta_{MF} = \frac{D}{2R} - \frac{D}{2R_{min}}$$

There is one additional input required, the extinction coefficient. This will be input as a table $\alpha$(A), which may depend upon ambient conditions and which must be interpolated for a given value of A, the average pressure altitude.

The equation which gives the flux is:

$$FDOT(A,R) = \frac{KP_0e^{-\alpha(A)\cdot R}}{\pi R^2(\theta^2{}_D + \theta J^2 + \theta_T{}^2 + \theta_{MF}^2)}$$

Note that the exponential term can be calculated without repeated use of exponentiation as the range R is stepped through. We have $$e^{-\alpha(R+\Delta R)} = e^{-\alpha R}e^{-\alpha\Delta R}.$$

Calculating the constant $C = e^{-\alpha\Delta R}$, we have $$e^{-\alpha(R+\Delta R)} = C\,e^{-\alpha R},$$

Which can be used to sequentially calculate the exponential.

Although the invention has been described with reference to a particular embodiment, it will be understood to those skilled in the art that the invention is capable of a variety of alternative embodiments within the spirit and scope of the appended claims.

What is claimed is:

1. A fire control apparatus for a laser weapon comprising in combination:
   - a laser weapon means,
   - means for sensing a threat target, said sensing means providing threat data related to said threat target,
   - a fire control computer means for:
     - receiving said threat data from said sensing means,
     - establishing a threat register to store threat data from said sensing means,
     - comparing said threat data with a predicted threat scenario to provide estimated future scenario time-lines,
     - monitoring the status of said laser weapon means,
     - providing a firing strategy menu,
     - providing weapon pointing sequence signals and firing on-off signals to said laser weapon means.

2. A fire control apparatus for a laser weapon as described in claim 1 further including an operator's control console to receive and display said weapon pointing sequence signals and said firing on-off time signals from said fire control computer means, said operator's control console including a manual laser weapon firing means.

3. A fire control apparatus for a laser weapon as described in claim 2 wherein said fire control computer means comprises in combination:
   - a threat register means for receiving and storing said threat data,
   - a memory means for storing a plurality of predicted threat scenarios, said memory means operatively connected to said threat register means to receive said threat data therefrom, said memory means providing a number of predicted threat scenarios corresponding to said threat data,
   - a comparator means operatively connected to said memory means for receiving said threat data and said number of predicted threat scenarios therefom; said comparator means comparing said threat data with said number of predicted threat scenarios and providing estimated future scenario time-lines,
   - a weapon status register for monitoring the status of said laser weapon means,
   - an engagement processing means operatively connected to said comparator means for receiving therefrom said estimated future scenario time-lines and operatively connected to weapon status register for receiving the status of said laser weapon means to provide a firing strategy menu, and,
   - a weapon control means for receiving said firing strategy menu from said engagement processing means and the status of said laser weapon means from said weapond status register to provide weapon pointing sequence signals and firing on-off time signals to said laser weapon means.

4. A fire control apparatus for a laser weapon as described in claim 3 wherein said operator's control console comprises a cathode ray tube display means with a manual data entry means.

5. A fire control apparatus for a laser weapon as described in claim 4 wherein said sensing means comprises a radar unit.

* * * * *